United States Patent [19]

Korenberg

[11] Patent Number: 4,830,604

[45] Date of Patent: May 16, 1989

[54] JET BURNER AND VAPORIZER METHOD AND APPARATUS

[75] Inventor: Jacob Korenberg, York, Pa.

[73] Assignee: Donlee Technologies Inc., York, Pa.

[21] Appl. No.: 44,733

[22] Filed: May 1, 1987

[51] Int. Cl.[4] ..... F23D 15/00

[52] U.S. Cl. ..... 431/158; 431/351

[58] Field of Search ..... 431/351, 353, 187, 188, 431/158, 10

[56] References Cited

U.S. PATENT DOCUMENTS

| | | | |
|---|---|---|---|
| 1,535,886 | 4/1925 | Zulver . | |
| 1,679,830 | 8/1928 | Lang . | |
| 2,465,675 | 3/1949 | De Lancey | 431/265 |
| 2,499,207 | 2/1950 | Wolfersperger | 431/158 |
| 3,173,499 | 3/1965 | Ross | 431/158 |
| 3,273,621 | 9/1966 | Childree | 158/7 |
| 3,376,098 | 4/1968 | Pryor | 431/10 |
| 3,998,581 | 12/1976 | Hemingway et al. | 431/158 |
| 4,003,692 | 1/1977 | Moore | 431/158 |
| 4,154,567 | 5/1979 | Dahmen | 431/5 |
| 4,240,784 | 12/1980 | Dauvergne | 431/351 |
| 4,245,980 | 1/1981 | Reed et al. | 431/351 |
| 4,260,367 | 4/1981 | Markowski et al. | 431/353 |

*Primary Examiner*—Carroll B. Dority, Jr.

*Attorney, Agent, or Firm*—Finnegan, Henderson, Farabow, Garrett & Dunner

[57] ABSTRACT

A process and apparatus for burning fuel includes supplying fuel and primary air to the upstream end portion of a longitudinally extending precombustion chamber having a longitudinally extending outer wall. Fuel and primary air are flowed in a longitudinal downstream direction through the precombustion chamber while self-sustained combustion is maintained in the precombustion chamber by partially precombusting, mixing and heating the mixture of fuel and primary air. The uncombusted fuel and combustion products are flowed through a primary nozzle at the downstream end of the precombustion chamber. Secondary air is flowed longitudinally in a downstream direction through a longitudinally extending secondary air chamber having a longitudinally extending outer wall surrounding the outer wall of the precombustion chamber. The longitudinally flowing secondary air is heated while it cools the outer wall of precombustion chamber. The secondary air is mixed with the uncombusted fuel and combustion products exiting the primary nozzle. The secondary air, uncombusted fuel and combustion products are flowed through a secondary nozzle at the downstream end of the secondary air chamber. The mixture of secondary and uncombusted fuel are combusted.

10 Claims, 1 Drawing Sheet

JET BURNER AND VAPORIZER METHOD AND APPARATUS

RELATED APPLICATIONS

The present application is related to U.S. patent application Ser. No. 07/044,735 by Jacob Korenberg entitled Cyclone Combustion Apparatus filed concurrently with this application and incorporated herein by reference.

BACKGROUND OF THE INVENTION

The present invention relates to a method and apparatus for burning fuel.

Many methods and apparatus are available for burning fuel. However, conventional burners are limited in the scope of their applications and are sensitive to their environments. As a result, conventional methods and apparatus for burning fuel, being specialized, are not individually usable in widely varying and adverse environments.

This drawback of conventional methods and apparatus for burning fuel, namely, the sensitivity to adverse environments also prevents such arrangements from providing a high turn-down ratio. The absence of such a high turn-down ratio prevent such burners from being operated at an economically efficient range of capacity in response to changes in demand.

Conventional burners which have advantageous characteristics are often complex and costly to construct and operate with specialized components which require costly machining. In addition, such burners often require additional components composed of refractory materials to insulate other components of the burner from exposure to excessive heat Conventional methods and apparatus for burning fuel, having these drawbacks, are inappropriate for wide ranges of applications. They do not appropriately combust either gaseous or liquid fuel in a self-sufficient and self-sustained manner. They do not combust such fuels appropriately both when used alone and in a system in which additional oxygen for combustion is supplied by air outside the system.

Also, conventional arrangements do not have a wide variety of applications for boilers, air heaters, and incinerators including cyclonic combustors. The operation of conventional methods and apparatus for burning fuel limit the miniaturization of fire tube diameters in boiler furnaces and therefore limit the miniaturization of furnace volume and the amount of specific heat release which is possible in such furnaces.

Additionally, when known methods and apparatus for burning premixed fuel in an incinerator are used, there is a limitation on the range of incinerator capacity due to the dangers of flashback at low capacity rates. As a result, conventional methods and apparatus for burning fuel used with incinerators have limitations on reliability, safety, performance and stability especially at reduced capacity.

Accordingly, it is an object of the present invention to provide a method and apparatus for burning fuel in widely-varying and adverse environments.

It is also an object of the present invention to provide a method and apparatus for burning fuel having a high turndown ratio.

It is a further object of the present invention to provide a method and apparatus for burning fuel which is simple in construction and operation and low in cost to build and operate.

It is an additional object of the present invention to provide a method and apparatus for burning fuel in which refractory materials are not required to insulate the components of the burner from exposure to heat.

It is also an object of the present invention to improve combustion by heating secondary air used in combustion.

It is a further object of the present invention to provide a method and apparatus for burning fuel in which the fuel and air are well mixed.

It is an additional object of the present invention to provide a method and apparatus for burning fuel in which a liquid fuel may be employed and completely vaporized before the final stage of combustion.

It is also the purpose of the present invention to provide a method and apparatus for burning fuel having these qualities which is capable of combusting either gaseous or liquid fuel.

It is a further object of the present invention to provide a method and apparatus for burning fuel which is self-sufficient and self-sustained in combustion and also usable with a system in which additional oxygen for combustion is supplied by air outside the system.

It is also an object of the present invention to provide a method and apparatus for burning fuel in which a narrow flame is produced so as to accommodate a boiler furnace having a smaller fire tube diameter and high burner gas exit velocity, to provide an intense combustion and relatively high heat transfer rate to the furnace walls and which allow the furnace volume to be significantly smaller.

It is additionally an object of the present invention to provide a method and apparatus for burning fuel which can be used in air heaters to produce the same advantages described above in boilers.

It is an additional object of the present invention to provide a method and apparatus for burning fuel which is usable with a liquid and gaseous waste incinerator by accomplishing a quick and intensive fuel combustion separated from the waste incineration process and used as a heat generator, so that the area of the incinerator chamber in which combustion occurs is a relatively small portion of the total area of the incinerator chamber.

It is also an object of the present invention to provide a method and apparatus for burning fuel which can be used with a cyclonic incinerator to significantly improve the incinerator's reliability, safety, performance, and its stability, especially at reduced units capacity.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

SUMMARY OF THE INVENTION

To achieve the foregoing objects, and in accordance with the purposes of the invention as embodied and broadly described herein, there is provided a process for burning fuel comprising: supplying fuel and primary air to the upstream end portion of a longitudinally extending precombustion chamber having a longitudinally extending outer wall; longitudinally flowing the fuel and primary air in a downstream direction through the precombustion chamber means while maintaining self-sustaining combustion in the precombustion chamber means by partially precombusting, mixing and heating the mixture of fuel and primary air; flowing the uncombusted fuel and combustion products through a primary nozzle at the downstream end of the precombustion chamber; longitudinally flowing secondary air in a downstream direction through a longitudinally extending secondary air chamber having a longitudinally extending outer wall surrounding the outer wall of the precombustion chamber while cooling the outer wall of the precombustion chamber and heating the secondary air; mixing the secondary air with the uncombusted fuel and combustion products exiting the primary nozzle; directing the flow of secondary air, uncombusted fuel and combustion products through a secondary nozzle at the downstream end of the secondary air chamber; and combusting the mixture of secondary air and uncombusted fuel.

Also, in accordance with the present invention there is provided a jet burner apparatus comprising longitudinally extending precombustion chamber means for longitudinally flowing, partially precombusting, mixing and heating fuel and primary air to maintain self-sustained combustion, the precombustion chamber means including a longitudinally extending outer wall, an upstream end portion and a downstream end portion, the upstream end portion including means for porting primary air into the precombustion chamber means and means for porting fuel into the precombustion chamber means, the downstream end portion including means for porting uncombusted fuel and combustion products out of the precombustion chamber means; primary nozzle means at the downstream end portion of the precombustion chamber means for directing the flow of uncombusted fuel and combustion products exiting from the downstream end portion of the precombustion chamber means; longitudinally extending secondary air chamber means surrounding the outer wall of the precombustion chamber means for flowing secondary air longitudinally along the outer wall of the precombustion chamber means and for receiving a transfer of heat from the precombustion chamber means to cool the outer wall of the precombustion chamber and heat secondary air within the secondary air chamber, the secondary air chamber means including a longitudinally extending outer wall, an upstream end portion and a downstream end portion, the upstream end portion including means for porting secondary air into the secondary air chamber means, the downstream end portion including means for porting secondary air out of the secondary air chamber means proximate to the primary nozzle means, for mixing the secondary air with the uncombusted fuel and combustion products exiting from the primary nozzle means and for combusting the mixture of secondary air and uncombusted fuel; and secondary nozzle means at the downstream end portion of the secondary air chamber means for directing the flow of secondary air, uncombusted fuel and combustion products exiting from the secondary air chamber means and the primary nozzle means.

BRIEF DESCRIPTION OF THE DRAWINGS

The accompanying drawings, which are incorporated in and constitute part of the specification, illustrate the presently preferred embodiment in the invention, and, together with the general description given above and the detailed description of the preferred embodiment given below, serve to explain the principles of the invention.

DESCRIPTION OF THE PREFERRED EMBODIMENT

Reference will now be made in detail to the present preferred embodiment of the invention as illustrated in the accompanying drawings.

In accordance with the present invention there is provided a jet burner comprising: longitudinally extending precombustion chamber means for longitudinally flowing, partially precombusting, mixing and heating fuel and primary air to maintain self-sustained combustion, the precombustion chamber means including a longitudinally extending outer wall, an upstream end portion and a downstream end portion, the upstream end portion including means for porting primary air into the precombustion chamber means and means for porting fuel into the precombustion chamber means, the downstream end portion including means for porting uncombusted fuel and combustion products out of the precombustion chamber means; primary nozzle means at the downstream end portion of the precombustion chamber means for directing the flow of uncombusted fuel and primary air exiting from the downstream end portion of the precombustion chamber means; longitudinally extending secondary air chamber means surrounding the outer wall of the precombustion chamber means for flowing secondary air longitudinally along the outer wall of the precombustion chamber means and for receiving a transfer of heat from the precombustion chamber means to cool the outer wall of the precombustion chamber and heat secondary air within the secondary air chamber, the secondary air chamber means including a longitudinally extending outer wall, an upstream end portion and a downstream end portion, the upstream end portion including means for porting secondary air into the secondary air chamber means, the downstream end portion including means for porting secondary air out of the secondary air chamber means proximate to the primary nozzle means, for mixing the secondary air with the uncombusted fuel and combustion products exiting from the primary nozzle means and for combusting the mixture of secondary air and uncombusted fuel; and secondary nozzle means at the downstream end portion of the secondary air chamber means for directing the flow of secondary air, uncombusted fuel and combustion products exiting from the secondary air chamber means and the primary nozzle means.

According to the present invention the jet burner includes longitudinally extending precombustion chamber means for longitudinally flowing, partially precombusting, mixing and heating fuel and primary air to maintain self-sustained combustion. The precombustion chamber includes a longitudinally extending outer wall, an upstream end portion and a downstream end portion.

Figure 1:
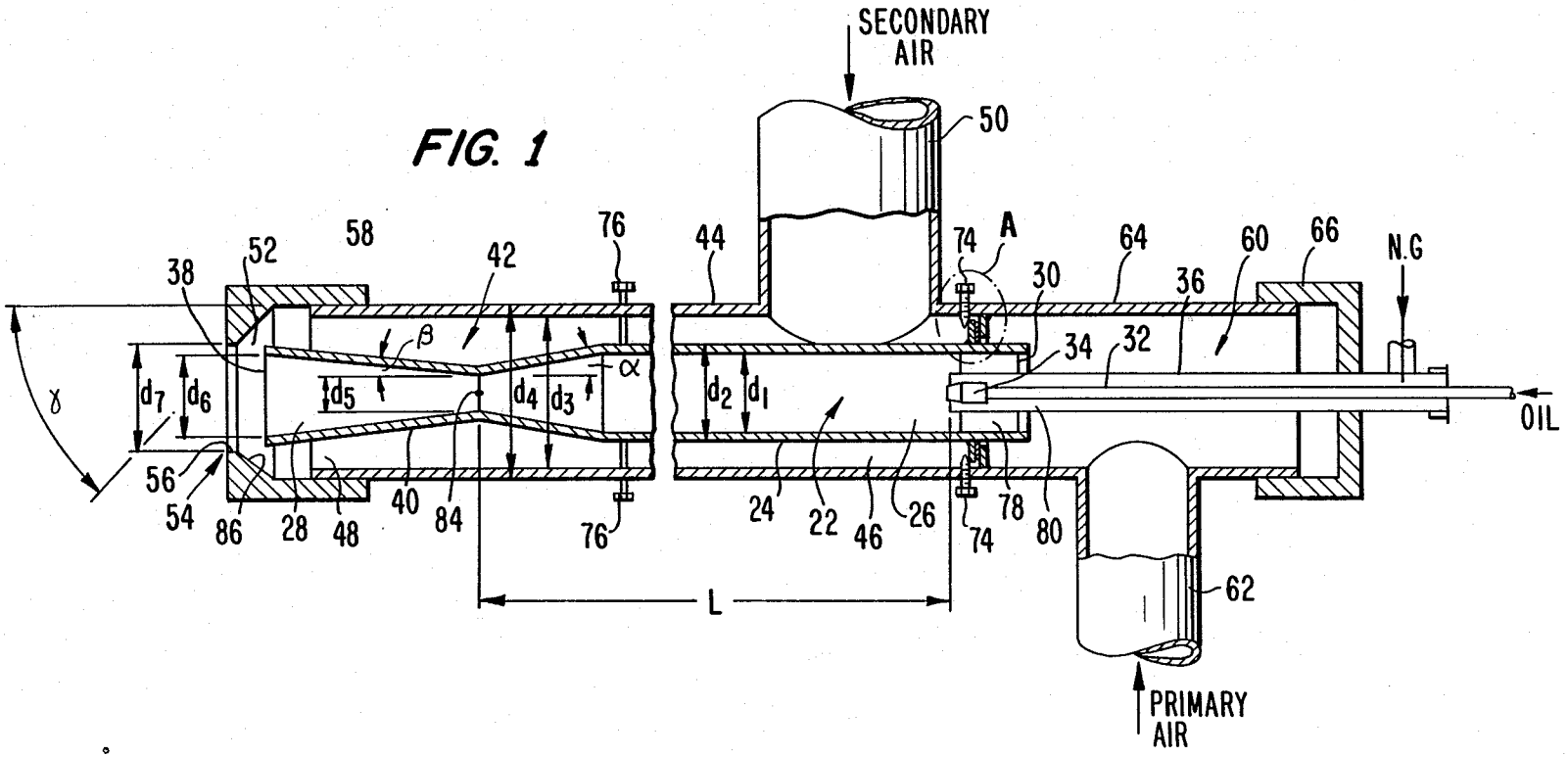
FIG. 1 is a side elevation view in cross section of a jet burner incorporating the teachings of the present invention.

As shown in FIG. 1, the longitudinally extending precombustion chamber means includes precombustion chamber 22 having a longitudinally extending outer wall 24 which longitudinally extends between an upstream end portion 26 and a downstream end portion 28. Preferably, outer wall 24 is generally cylindrical in shape.

According to the present invention, the upstream end portion includes means for porting air into the precombustion chamber means and means for porting fuel into the precombustion chamber means and the downstream end portion includes means for porting uncombusted fuel and combustion products out of the precombustion chamber means. As shown in FIG. 1, the means for porting primary air into the precombustion chamber means includes the open upstream stream axial end 30 of precombustion chamber 22.

It is preferable that the means for porting fuel into the precombustion chamber means includes means for alternatively porting liquid and gaseous fuel. As shown in FIG. 1, the means for porting fuel into the precombustion chamber means includes liquid fuel supply pipe 32 which supplies a liquid fuel such as fuel oil through the open upstream axial end 30 of precombustion chamber 22. A liquid fuel nozzle 34 at the end of liquid fuel supply pipe 32 sprays the liquid fuel into precombustion chamber 22. A gaseous fuel supply pipe 36 surrounds liquid fuel supply pipe 32 to create an annular space between the two pipes for supplying gaseous fuel to the upstream end 26 of precombustion chamber 22. The means for porting uncombusted fuel and combustion products out of the precombustion chamber means includes the open downstream axial end 38 of precombustion chamber 22.

According to the present invention, there is provided primary nozzle means at the downstream end portion of the precombustion chamber means for directing the flow of uncombusted fuel and combustion products exiting from the downstream end portion of the precombustion chamber means. It is preferable that the primary nozzle means is formed by the downstream end portion of the outer wall of the precombustion chamber means and is a convergent-divergent shaped jet nozzle. As shown in FIG. 1, the primary nozzle means is a primary nozzle 40 formed in the downstream end portion 28 of precombustion chamber 22. Primary nozzle 40 is a convergent-divergent shaped jet nozzle with a throat 84.

According to the present invention there is provided longitudinally extending secondary air chamber means surrounding the outer wall of the precombustion chamber means for flowing secondary air longitudinally along the outer wall of the precombustion chamber means and for receiving a transfer of heat from the precombustion chamber means to cool the outer wall of the precombustion chamber and heat secondary air within the secondary air chamber.

As shown in FIG. 1, the secondary air chamber means includes secondary air chamber 42 which surrounds the outer wall 24 of precombustion chamber 22.

According to the present invention, the secondary air chamber means includes a longitudinally extending outer wall, an upstream end portion and a downstream end portion. It is also preferable that the means for porting secondary air into the secondary air chamber means is located about the same longitudinal position as the means for porting fuel into the precombustion chamber means. It is preferable that the outer wall of the secondary air chamber means is generally cylindrical in shape.

As shown in FIG. 1, the longitudinally extending outer wall of the secondary chamber means includes a generally cylindrical outer wall 44 which surrounds and is spaced from outer wall 24 of precombustion chamber means 22, and has an upstream end portion 46 generally corresponding to the longitudinal position of the upstream end portion 46 of the precombustion chamber 22. The secondary air chamber 42 also has a downstream end portion 48 generally corresponding to the longitudinal position of the downstream end portion 28 of precombustion chamber 22.

According to the present invention, the upstream end portion of the secondary air chamber means includes means for porting secondary air into the secondary air chamber means and the downsteam end portion includes means for porting secondary air out of the secondary air chamber means proximate to the primary nozzle means, for mixing the secondary air with the uncombusted fuel and combustion products exiting from the primary nozzle means and for combusting the mixture of secondary air and uncombusted fuel.

As shown in FIG. 1, the means for porting secondary air into the secondary air chamber means includes secondary air supply pipe 50 located at and communicating with the upstream end portion 46 of secondary air chamber 42. The means for porting secondary air out of the secondary air chamber means proximate to the primary nozzle means includes an annular clearance 52 between the downstream end of the outer wall 44 of secondary air chamber 42 and the downsteam end of the outer wall 24 of precombustion chamber 22.

According to the present invention, there is provided secondary nozzle means at the downstream end portion of the secondary air chamber means for directing the flow of secondary air, uncombusted fuel and combustion products exiting from the secondary air chamber means and the primary nozzle means. It is preferable that the secondary nozzle means includes end cap means adjustably positionable in the longitudinal direction relative to the outer wall of the secondary air chamber means for adjusting flow of the secondary air through the secondary nozzle. As shown in FIG. 1, the secondary nozzle means includes a secondary nozzle 54 having a circular aperture 56 which is centered and downstream of the open downstream axial end 38 of precombustion chamber 22. The end cap means includes an end cap 58 which is threaded on the downstream end portion 48 of secondary air chamber 42 so that clearance 52 can be adjusted to adjust the flow of secondary air through clearance 52.

It is preferable that the means for porting primary air into the precombustion chamber means includes an air box having a longitudinally extending outer wall which is integral with the longitudinally extending outer wall of the secondary air chamber means. As shown in FIG. 1, the means for porting primary air includes air box 60 which is in communication with the open upstream axial end 30 of precombustion chamber 22. Primary air supplied by pipe 62 supplies primary air to air box 60 which is then communicated to precombustion chamber 22 through the open upstream axial end 30 of precombustion chamber 22. The outer wall 64 of the air box 60 is generally cylindrical and integral with the cylindrical longitudinally extending outer wall 44 of secondary air chamber 42. The diameter of these two outer walls is preferably uniform and continuous.

It is preferable that the air box includes end cap means for enclosing the air box and supporting the means for porting fuel into the precombustion chamber means. As shown in FIG. 1, the end cap means for the air box includes end cap 66 which is preferably threaded on the end of air box 60. The means for porting fuel, namely liquid fuel supply pipe 32 and gaseous supply pipe 36 pass through an aperture in the central portion of end cap 66 and are sealed to end cap 66.

It is preferable that seal means are provided for isolating the air box from the secondary air chamber means. It is also preferable that the seal means include complementary flanges on the outside of the outer wall of the precombustion chamber means and on the inside of the outer wall of the secondary air chamber means. It is further preferable that the seal means includes screw means in the outer wall of the secondary air chamber means for pressing the flange on the precombustion chamber means against the flange on the secondary air chamber means.

Figure 2:
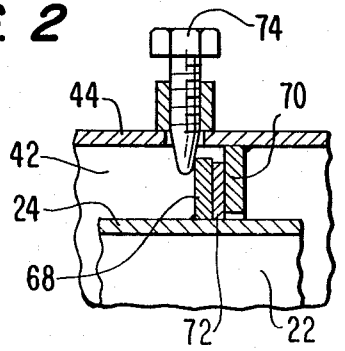
FIG. 2 is a detail of the joint in circle A of FIG. 1.

As shown in FIG. 2, which is a detail of the joint A shown in FIG. 1, the seal means includes complementary flanges including first flange 68 extending circumferentially outward from outer wall 24 of precombustion chamber 22, and second flange 70 which extends circumferentially inward from outer wall 44 of secondary air chamber 42. Circumferential gasket 72 is interposed between first flange 68 and second flange 70 to pack the joint and isolate the primary air in air box 60 from the secondary air and secondary air chamber 42. The screw means includes a plurality of circumferentially spaced seal screws 74 which are threaded into the outer wall 44 of secondary air chamber 42 and which have a tapered leading tip which forces first flange 68 toward second flange 70 to maintain a tight joint.

It is also preferable to provide screw means in the outer wall of the secondary air chamber means for radially positioning the precombustion chamber means relative to the secondary air chamber means. As shown in FIG. 1, the screw means for radially positioning the precombustion chamber means include positioning screws 76 which are threaded into the outer wall 44 of secondary air chamber 42 at spaced points around the periphery so that the leading ends of positioning screw 76 engage the outer wall 24 of precombustion chamber 22 for radially positioning the outer wall 24 of precombustion chamber 22 relative to the outer wall 44 of secondary air chamber 42.

Spacers 78 are used to center gaseous fuel supply pipe 36 within the outer wall 24 or precombustion chamber 22. Also, spacers 80 are used to position liquid fuel supply pipe 32 in the center of gaseous fuel supply pipe 36.

An electrode (not shown) for generating a spark to ignite the fuel in the precombustion chamber is provided in front of the fuel nozzle 34.

It can be seen by this description of the present invention and the embodiment of the apparatus, that the construction and assembly of the apparatus is simple and low in cost. Most of the parts can be made from pieces of pipe which do not require much machining. A burner having a higher capacity could be built from pieces of duct rather than pipes. Despite the simplicity of construction, the values of various parameters of the arrangement are important to effective and efficient operation. Parameters to be considered in constructing and operating the present invention will now be discussed.

As shown in FIG. 1, the longitudinal distance between the point at which fuel is ported into precombustion chamber 22, and the throat 84 of the convergent-divergent primary nozzle 40 is defined as length L. In designing the burner, an increase in length L would have a detrimental affect upon burner stability. The length L is determined by considering the following parameters: (1) the type of fuel, whether gaseous or liquid (L can be shorter for gaseous fuel than liquid fuel because gaseous fuel does not need to be vaporized.), (2) the primary and secondary air velocities in and around precombustion chamber 22, which control the rate of combustion and the temperature of the precombustion chamber and its outer wall 24, and (3) the specific cooling surface per unit of burned fuel in precombustion chamber 22 (As the cooling surface increases, temperature and $NO_x$ decreases at the burner exit.).

For a dual fuel burner such as that shown in FIG. 1, length L preferably has the minimum value which provides stable and sustained combustion of the liquid fuel at the burner's whole range of design capacity. At any rate at which the burner is operated, the amount of heat generated by the partial fuel combustion in precombustion chamber 22 should be sufficient to evaporate the remainder of the uncombusted liquid fuel, to transfer heat through outer wall 24 of precombustion chamber 22 (which is cooled by secondary air in secondary chamber 42) and to generate combustion gases and fuel oil vapor at a temperature at which combustion is self-sustained regardless of the environment downstream of the fuel burner.

The diameter of throat 84 of the convergent-divergent jet primary nozzle 40 is also very important for proper burner performance. In FIG. 1, the diameter throat 84 is indicated as $d_5$. If the diameter $d_5$ of throat 84 is too big, the gas velocity at the burners low capacity will be too low to vaporize all the sprayed fuel when liquid fuel is used. Such insufficient vaporization diminishes the combustion efficiency of the burner. On the other hand, if the diameter $d_5$ of throat 84 is too small, the gas velocity could become very high and could create an unacceptably high burner pressure drop.

As noted above, end cap 58 of secondary nozzle 54 can be screwed in and out to change the width of clearance 52 which, as a result, would change the secondary air exit velocity at clearance 52. The adjustment of clearance 52 affects burner performance including flame shape and length downstream of secondary nozzle 54. Higher secondary air velocity causes higher pressure to result at clearance 52.

The angle of convergence of primary nozzle 40 is taken between the converging wall and an axial line, shown in FIG. 1 as angle alpha ($\alpha$). The angle of divergence of primary nozzle 40 is taken between the diverging wall of primary nozzle 40 to an axial line, and is shown in FIG. 1 as angle beta ($\beta$). Angles alpha and beta are chosen in accordance with jet theory so as to provide an optimum conversion of the potential energy of pressurized gas into the kinetic energy of the flue gas velocity in throat 84 and its partial recovery back again into the potential energy during gas expansion in the divergent part of primary nozzle 40.

The end cap 58 having secondary nozzle 54 includes a divergent inner surface 86. The angle formed between this divergent inner surface and an axial line is shown as angle gamma ($\gamma$) in FIG. 1. Angle gamma is also important for burner performance. As angle gamma increases, the flame becomes shorter, and as angle gamma decreases, the flame becomes longer.

$NO_x$ formation rate downstream of nozzle 54 depends upon the combustion temperature in precombustion chamber 22 and the length of the burner's flame if the burner is installed in a furnace with water cooled walls.

The present invention as described and illustrated allows the secondary air in secondary air chamber 42 to play a dual role as a coolant to prevent the metal wall of precombustion chamber 22 from overheating as well as serving as an oxygen carrier for fuel combustion downstream of the secondary nozzle 54. The heating of the secondary air, and thus the improved combustion downstream of the secondary nozzle 54 is not dependent on the temperature of the environment downstream of the burner, such as the furnace in which the jet burner is positioned and is also generally not dependent upon any other heating source external to the jet burner.

The present invention has a variety of applications. It may be used as a vaporizing device for liquid fuel when the total primary and secondary air supply rates are below the rate for stoichiometric combustion of the fuel. In such cases, tertiary air is supplied outside the jet burner/vaporizer in the furnace with which the jet burner/vaporizer is used, so that the fuel becomes fully combusted when combined and reacted with the tertiary air in the furnace. The same general principles apply for combustion using gaseous fuels so that the jet burner becomes a jet preburner to enhance the combustion characteristics.

The present invention may also be used with a boiler, air heater, or liquid and gaseous waste incinerators.

The present invention is advantageous for use in a boiler due to the possibility of the narrow flame produced by the jet burner. As a result, the boiler furnace can be designed to have a smaller diameter fire tube and higher burner gas exit velocity to provide an intense combustion and relatively high heat transfer rate to the furnace walls and which allow the furnace volume to be significantly smaller.

The same advantages occur when the jet burner of the present invention is used with air heaters. However, some alternative provision must be made for cooling the furnace walls in air heaters.

The jet burner of the present invention may also be used with liquid and gaseous waste incinerators. Requirements for fuel combustion in cyclonic incinerators are much more demanding than for conventional cyclonic fuel-fired combustors. In fuel-fired combustors, the combustion process fills the whole internal volume of the cyclone and even can be completed beyond the cyclone exit. In contrast, the cyclonic incinerator burns out a main portion of the fuel in the incinerator head so that the best conditions can be provided for liquid water treatment and the highest specific capacity.

The necessity of the high combustion intensity of the fuel in the incinerator head is dictated by the fact that the main reactor zone works at a comparatively lower temperature (950° C. through 1000° C.). Also, the liquid waste sometimes contains combustion inhibitors which suppress fuel combustion. As a result, liquid waste incineration has two distinct zones: (a) a fuel combustion zone and (b) a technological zone where liquid is evaporated and organic substances are oxidized.

To quickly and intensively combust the fuel, premixed gaseous fuel burners have been used for firing cyclonic incinerators. Premixed fuel burners have the possibility of causing flashback into the mixer and explosion, a hazard which is a major disadvantage of the premixed fuel burners. This disadvantage requires limitations on the capacity and air temperature level of premixed fuel burners in order to avoid the possibility of the burner being destroyed due to flashback.

To prevent flashback, one is compelled to design the burners with a gas/air mixture velocity which is unjustifiably high in terms of energy consumption. This results in the burner converging nozzle having a very narrow range of turn down ratio (TDR) especially when air is preheated and burner capacity is high, conditions which require larger diameter nozzles.

Burners of premixed fuel have to be provided with a water cooled nozzle that by itself represent an additional cost and complication due to the extra structure required.

With any type of burners used for firing a cyclonic furnace, combustion is mostly (more than 98%) completed at a distance from the entry of the fuel/air mixture of approximately 0.5 through 0.7 of the diameter D of the cyclonic furnace. The length of the cyclonic furnace is approximately two times the diameter D of the cyclonic furnace. This means that about up to 35% of the cyclone furnace volume is used for fuel combustion as opposed to the decomposition of the waste which is occurring in the remainder of the furnace. Therefore, the part of the cyclonic furnace designated for fuel combustion is of a crucial importance.

Larger size cyclonic furnaces require a greater number of burners which have a capacity with a top limit at a reasonable gas/air mixture exit velocity. An increased number of burners makes a unit more expensive, and complex due to a requirement for more ducting and piping, and creates difficulties also in providing an even distribution of gas and air between burners.

As a conclusion of the above discussion, combining the jet burner with a cyclonic incinerator would significantly improve incinerator reliability, safety, performance and stability, especially at the incinerator's minimum capacity.

Illustrative presently preferred values for a jet burner/oil vaporizer having 2½ million BTU/hour input include the following.

The total distance from end cap 66 of air box 60 to end cap 58 of the secondary nozzle 54 is approximately 30 inches.

The length (Length L) from the fuel port at the upstream end of the precombustion chamber 22 to the throat 84 of primary nozzle 40 is approximately 20 inches.

The inside diameter (diameter $d_1$) of precombustion chamber 22 upstream of primary nozzle 40 is 2.067 inches.

The outside diameter (diameter $d_2$) of precombustion chamber outer wall 24 upstream of the primary nozzle 40 is 2.375 inches.

The inside diameter (diameter $d_3$) of the outer wall 44 of secondary air chamber 42 is 4.026 inches.

The outside diameter (diameter $d_4$) of the outer wall 44 of secondary air chamber 42 is 4.500 inches.

The diameter (diameter $d_5$) of the throat 84 of primary nozzle 40 is 1.250 inches.

The diameter (diameter $d_6$) of the downstream axial end 38 of precombustion chamber 22 is 3.000 inches.

The circular aperture 56 in secondary nozzle 54 is 3.25 inches.

The inside angle (angle gamma) of secondary nozzle end cap 58 is in a range from about 60° in the embodiment shown, to about angle beta in an arrangement in which surface 86 is aligned with the divergent portion of nozzle 40.

The temperature in precombustion chamber 22 can be about 1300°–1800° F.

The method of operation of the present invention will now be described. In accordance with the present invention, there is provided a process for burning fuel comprising supplying fuel and primary air to the upstream end portion of a longitudinally extending precombustion chamber having a longitudinally extending outer wall; longitudinally flowing the fuel and primary air in a downstream direction through the precombustion chamber means while maintaining self-sustained combustion in the precombustion chamber means by partially precombusting, mixing and heating the mixture of fuel and primary air; flowing the uncombusted fuel and combustion products through a primary nozzle at the downstream end of the precombustion chamber; longitudinally flowing the secondary air in a downstream direction through a longitudinally extending secondary air chamber having a longitudinally extending outer wall surrounding the outer wall of the precombustion chamber while cooling the outer wall of the precombustion chamber and heating the secondary air; mixing the secondary air with the uncombusted fuel and combination products exiting the primary nozzle; flowing the secondary air, uncombusted fuel and combustion products through a secondary nozzle at the downstream and of the secondary air chamber; and combusting the mixture of secondary air and uncombusted fuel.

As shown in FIG. 1, natural gas or oil is supplied through respective gas fuel supply pipe 36 and liquid fuel supply pipe 32 into the upstream end portion 26 of precombustion chamber 22. Primary air is supplied through primary supply pipe 62 into air box 60 and then through the open upstream axial end 30 of precombustion chamber 22. The fuel and primary air flows in a downstream direction through precombustion chamber 22 while maintaining self-sustained combustion in the precombustion chamber by partially precombusting, mixing and heating the mixture fuel and primary air.

The uncombusted fuel and combustion gases are flowed through a primary nozzle at the downstream end of the precombustion chamber. The primary nozzle 40 is preferably a convergent-divergent jet nozzle which increases mixing and other characteristics of flow.

At the same time, the method includes longitudinally flowing secondary air in a downstream direction through a longitudinally extending secondary air chamber having a longitudinally extending outer wall surrounding the outer wall of the precombustion chamber while cooling the outer wall of the precombustion chamber and heating the secondary air. Secondary air is supplied through secondary air pipe 50 to secondary air chamber 42 surrounding precombustion chamber 22 and is flowed downstream.

The method also includes mixing and combusting the secondary air with the partially precombusted fuel and primary air exiting the primary nozzle and flowing the secondary air, primary air and partially combusted fuel through a secondary nozzle at the downstream end of the secondary air chamber. This mixing and combusting occur in the area of the jet burner downstream of the secondary nozzle 54.

The method may additionally include using tertiary air to combust uncombusted fuel downstream of the jet burner. Such tertiary air is supplied by the environment in which the jet burner is located.

It is preferable that when liquid fuel is used that substantially all of the liquid fuel is vaporized during its passage through the precombustion chamber 22 to enhance combustion at secondary nozzle 54.

It is also preferable that the step of supplying primary air includes supplying primary air at a rate so that substantially all oxygen is consumed in the combustion products exiting through the primary nozzle.

It can be seen that the jet burner/oil vaporizer method and apparatus overcomes disadvantages present in conventional methods and apparatus for combusting fuel. Additional advantages and modifications will readily occur to those skilled in the art. The invention in its broader aspects is, therefore, not limited to the specific details, representative apparatus and method and illustrative example shown and described. Accordingly, departures may be made from such details without departing from the spirit or scope of the general inventive concept as defined by the appended claims and their equivalents.

What is claimed is:

1. A jet burner comprising:

longitudinally extending precombustion chamber means for longitudinally flowing, partially precombusting, mixing and heating fuel and primary air to maintain self-sustained combustion, the precombustion chamber means including a longitudinally extending thermally conductive outer wall, an upstream end portion and a downstream end portion, the upstream end portion including means for porting primary air into the precombustion chamber means and means for porting fuel into the precombustion chamber means, the downstream end portion including means for porting uncombusted fuel and combustion products out of the precombustion chamber means;

primary nozzle means at the downstream end portion of the precombustion chamber means for directing the flow of uncombusted fuel and combustion products exiting from the downstream end portion of the precombustion chamber means, said primary nozzle means being formed by the downstream end portion of the outer wall of the precombustion chamber and being a convergent-divergent shaped jet nozzle;

longitudinally extending secondary air chamber means surrounding the outer wall of the precombustion chamber means for flowing secondary air longitudinally along the outer wall of the precombustion chamber means and for receiving a transfer of heat from the precombustion chamber means to cool the outer wall of the precombustion chamber and heat secondary air within the secondary air chamber, the secondary air chamber means including a longitudinally extending outer wall, an upstream end portion and a downstream end portion, the upstream end portion including means for porting secondary air into the secondary air chamber means, the downstream end portion including means for porting secondary air out of the secondary air chamber means proximate to the primary nozzle means, for mixing the secondary air with the uncombusted fuel and combustion products exiting from the primary nozzle means and for combusting the mixture of secondary air and uncombusted fuel; and secondary nozzle means at the downstream end portion of the secondary air chamber means for directing the flow of secondary air, uncombusted fuel and combustion products exiting from the secondary air chamber means and the primary nozzle means.

2. The jet burner of claim 1 wherein the outer wall of the precombustion chamber means is generally cylindrical in shape.

3. The jet burner of claim 2 wherein the outer wall of the secondary air chamber means is generally cylindrical in shape.

4. The jet burner of claim 1 wherein the means for porting secondary air into the secondary air chamber means is located at about the same longitudinal position as the means for porting fuel into the precombustion chamber means.

5. The jet burner of claim 1 wherein the means for porting fuel into the precombustion chamber means includes means for porting liquid fuel and gaseous fuel.

6. A jet burner comprising:

longitudinally extending precombustion chamber means for longitudinally flowing, partially precombusting, mixing and heating fuel and primary air to maintain self-sustained combustion, the precombustion chamber means including a longitudinally extending thermally conductive outer wall, an upstream end portion and a downstream end portion, the upstream end portion including means for porting primary air into the precombustion chamber and means for porting fuel into the precombustion chamber means, the means for porting primary air into the precombustion chamber means including an air box having a longitudinally extending outer wall, the downstream end portion including means for porting uncombusted fuel and combustion products out of the precombustion chamber means;

primary nozzle means at the downstream end portion of the precombustion chamber means for directing the flow of uncombusted fuel and combustion products exiting from the downstream end portion of the precombustion chamber means;

longitudinally extending secondary air chamber means surrounding the outer wall of the precombustion chamber means for flowing secondary air longitudinally along the outer wall of the precombustion chamber means and for receiving a transfer of heat from the precombustion chamber means to cool the outer wall of the precombustion chamber and heat secondary air within the secondary air chamber, the secondary air chamber means including a longitudinally extending outer wall which is integral with the longitudinally extending outer wall of the air box, an upstream end portion and a downstream portion, the upstream end portion including means for porting secondary air into the secondary air chamber means, the downstream end portion including means for porting secondary air out of the secondary air chamber means proximate to the primary nozzle means, for mixing the secondary air with the uncombusted fuel and combustion products exiting from the primary nozzle means and for combusting the mixture of secondary air and uncombusted fuel;

seal means for isolating the air box from the secondary air chamber means, said seal means including complimentary flanges on the outside of the outer wall of the precombustion chamber means and on the inside of the outer wall of the secondary air chamber means; and secondary nozzle means at the downstream end portion of the secondary air chamber means for directing the flow of secondary air, uncombusted fuel and combustion products exiting from the secondary air chamber means and the primary nozzle means.

7. The jet burner of claim 6 wherein the air box includes end cap means for enclosing the air box and supporting the means for porting fuel into the precombustion chamber means.

8. The jet burner of claim 6 wherein the seal means includes screw means in the outer wall of the secondary air chamber means for pressing the flange on the precombustion chamber means against the flange on the secondary air chamber means.

9. A jet burner comprising:

longitudinally extending precombustion chamber means for longitudinally flowing, partially precombusting, mixing and heating fuel and primary air to maintain self-sustained combustion, the precombustion chamber means including a longitudinally extending thermally conductive outer wall, an upstream end portion and a downstream end portion, the upstream end portion including means for porting primary air into the precombustion chamber means and means for porting fuel into the precombustion chamber means, the downstream end portion including means for porting uncombusted fuel and combustion products out of the precombustion chamber means;

primary nozzle means at the downstream end portion of the precombustion chamber means for directing the flow of uncombusted fuel and combustion products exiting from the downstream end portion of the precombustion chamber means;

longitudinally extending secondary air chamber means surrounding the outer wall of the precombustion chamber means for flowing secondary air longitudinally along the outer wall of the precombustion chamber means and for receiving a transfer of heat from the precombustion chamber means to cool the outer wall of the precombustion chamber and heat secondary air within the secondary air chamber, the secondary air chamber means including a longitudinally extending outer wall, an upstream end portion and a downstream end portion, the upstream end portion including means for porting secondary air into the secondary air chamber means, the downstream end portion including means for porting secondary air out of the secondary air chamber means proximate to the primary nozzle means, for mixing the secondary air with the uncombusted fuel and combustion products exiting from the primary nozzle means and for combusting the mixture of secondary air and uncombusted fuel; and secondary nozzle means at the downstream end portion of the secondary air chamber means for directing the flow of secondary air, uncombusted fuel and combustion products exiting from the secondary air chamber means and the primary nozzle means, the secondary nozzle means including end cap means adjustably positionable in the longitudinal direction relative to the outer wall of the secondary air chamber means for adjusting the flow of secondary air through the secondary nozzle means.

10. A jet burner comprising:

longitudinally extending precombustion chamber means for longitudinally flowing, partially precombusting, mixing and heating fuel and primary air to maintain self-sustained combustion, the precombustion chamber means including a longitudinally extending thermally conductive outer wall, an upstream end portion and a downstream end portion, the upstream end portion including means for porting primary air into the precombustion chamber means and means for porting fuel into the precombustion chamber means, the downstream end portion including means for porting uncombusted fuel and combustion products out of the precombustion chamber means;

primary nozzle means at the downstream end portion of the precombustion chamber means for directing the flow of uncombusted fuel and combustion products exiting from the downstream end portion of the precombustion chamber means;

longitudinally extending secondary air chamber means surrounding the outer wall of the precombustion chamber means for flowing secondary air longitudinally along the outer wall of the precombustion chamber means and for receiving a transfer of heat from the precombustion chamber means to cool the outer wall of the precombustion chamber and heat secondary air within the secondary air chamber, the secondary air chamber means including a longitudinally extending outer wall, an upstream end portion and a downstream end portion, the upstream end portion including means for porting secondary air into the secondary air chamber means, the downstream end portion including means for porting secondary air out of the secondary air chamber means proximate to the primary nozzle means, for mixing the secondary air with the uncombusted fuel and combustion products exiting from the primary nozzle means and for combusting the mixture of secondary air and uncombusted fuels;

screw means in the outer wall of the secondary air chamber means for radially positioning the precombustion chamber means relative to the secondary air chamber means to center the precombustion chamber means within the secondary air chamber means; and secondary nozzle means at the downstream end portion of the secondary air chamber means for directing the flow of secondary air, uncombusted fuel and combustion products exiting from the secondary air chamber means and the primary nozzle means.

* * * * *